United States Patent [19]

Yamamoto

[11] Patent Number: 4,844,313

[45] Date of Patent: Jul. 4, 1989

[54] FEED DEVICE FOR LONG AND NARROW STRIPS OF CONTINUOUS PACKAGE

[75] Inventor: Kaoru Yamamoto, Kyoto, Japan

[73] Assignee: Tetra Pak International Aktiebolag, Alle Lund, Sweden

[21] Appl. No.: 157,138

[22] Filed: Feb. 10, 1988

Related U.S. Application Data

[63] Continuation of Ser. No. 829,554, Feb. 13, 1986, abandoned, which is a continuation of Ser. No. 565,018, Dec. 22, 1983, abandoned.

[51] Int. Cl.[4] ..... B65H 20/00; B65H 23/04

[52] U.S. Cl. ..... 226/83; 226/87; 226/174

[58] Field of Search ..... 226/52, 53, 76, 77, 226/86, 87, 168, 174, 82, 85, 84, 83; 83/423

[56] References Cited

U.S. PATENT DOCUMENTS

| | | | |
|---|---|---|---|
| 993,732 | 5/1911 | Storck | 226/52 |
| 1,723,950 | 8/1929 | Mueller | 226/85 X |
| 1,852,419 | 4/1932 | Kuchenmeister | 226/85 |
| 1,980,463 | 11/1934 | Wright | 226/82 X |
| 2,781,841 | 2/1957 | Dignan | 226/82 X |
| 3,199,671 | 8/1965 | Davy | 226/76 X |
| 3,199,756 | 8/1965 | Davy | 226/76 |
| 3,628,408 | 12/1971 | Rod | 83/423 X |
| 4,026,756 | 5/1977 | Stanfield et al. | 226/85 X |
| 4,351,461 | 9/1982 | Carlsson | 226/52 X |

*Primary Examiner*—Harvey C. Hornsby
*Assistant Examiner*—Scott J. Haugland
*Attorney, Agent, or Firm*—Koda and Androlia

[57] ABSTRACT

A feed device for a long and narrow strip of continuous package wherein the continuous package includes a plurality of wrapped articles connected together by a connecting part and the rigidity of the wrapped articles is different than the rigidity of the connecting part. The feed device is further characterized by a rotatable member in contact with the continuous package and a plurality of ridge parts provided in parallel to each other on the rotatable member and a tension device for applying sufficient tension to draw the connecting part over the ridged parts but insufficient to draw the wrapped articles over the ridged parts.

6 Claims, 6 Drawing Sheets

FEED DEVICE FOR LONG AND NARROW STRIPS OF CONTINUOUS PACKAGE

This is a continuation of application Ser. No. 829,554, filed Feb. 13, 1986 now abandoned.

This is a continuation of application Ser. No. 829,554, filed Feb. 13, 1986 now abandoned.

BACKGROUND OF THE INVENTION

1. Field of the Invention

The present invention relates to a feed device for delivering a long and narrow strip of continuous package in which numerous commodities are packaged therein at a predetermined pitch.

2. Prior Art

As shown in FIG. 1, when adhering a spoon B in a small bag D' to the external side surface of a package container A, the process may be in a sequence of making a long, narrow strip of continuous package D, as shown in FIG. 2, in which the packages, made of two sheets of film containing a spoon B welded together at predetermined positions so as to seal them off and cutting the long and narrow strip of continuous package D into packages D' in which a spoon B is sealed off and adhering the packages D' to the food package container A.

In prior art devices which are in part illustrated in FIG. 3, the long and narrow strip of continuous package D (usually called a rudder) is rolled up and kept for delivery by a feed roller 1 and is supplied at a distance equal to one spoon per pitch to a cutter mechanism 3 and is subsequently cut so as to form the packages D' containing a spoon which are adhered to the food package container A by adhering device 4.

The device having the above described structure must deliver the continuous package D at a constant pitch P of a distance equal to the width of the package D' when supplying the long, narrow strip of continuous package D to the cutting mechanism 3. Conventional feed devices have a disadvantage in that there is wide variation in the cutting position because of errors in measurement which are caused by a small warpage of the pitch P originating from expansion and contraction due to a change in temperature, errors in measurement at the production and tensile elongation of the materials which are gradually added together from the long and narrow strip of continuous package D is processed to be cut. That is, when the cutting position unavoidably moves away from the part C which has been welded in a widthwise direction of the long and narrow strip of continuous package D each of the packages D' is opened and unusable.

SUMMARY OF THE INVENTION

Accordingly, it is a general object of the present invention to provide a feeding device which overcomes the disadvantages of the prior art.

It is another object of the present invention to provide a feeding device which accurately feeds the continuous package to the cutter.

It is still another object of the present invention to provide a feeding device which is simple in construction.

In keeping with the principals of the present invention, the objects are accomplished by a unique feeding device for feeding and controlling the position of wrapped articles before their separation from a continuous strip package wherein the continuous package includes a plurality of wrapped articles connected together by a connecting part and the rigidity of the wrapped articles is different from the rigidity of the connecting part. The feed device is characterized by a rotatable member in contact with the continuous package and a plurality of ridge parts provided in parallel to each other on the rotatable member and a tension device for applying sufficient tension to draw the connecting part over the ridged parts but insufficient to draw the wrapped articles over the ridged parts.

BRIEF DESCRIPTION OF THE DRAWINGS

The above-mentioned features and objects of the present invention will become more apparent with reference to the following description taken in conjunction with the accompanying drawings wherein like reference numerals denote like elements and in which.

DETAILED DESCRIPTION OF THE INVENTION

Figure 2:
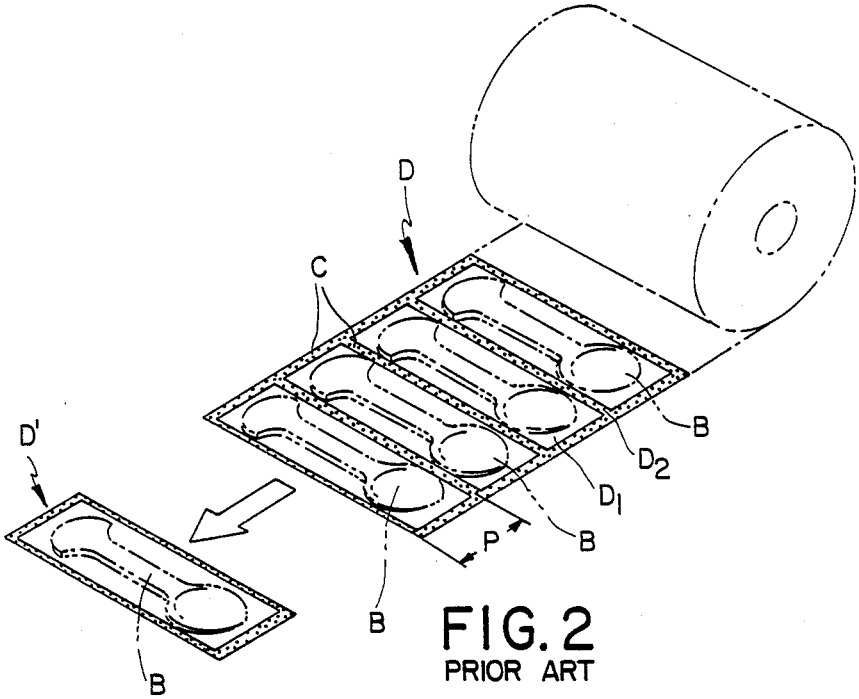
FIG. 2 PRIOR ART
FIG. 2 is a perspective view of a long and narrow strip of continuous package for spoons.
Figure 1:
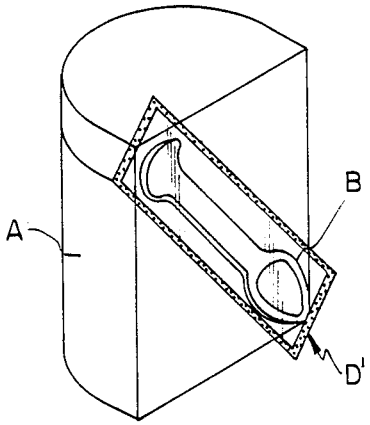
FIG. 1 PRIOR ART
FIG. 1 is a perspective view of a food package container to which a spoon is adhered.
Figure 3:
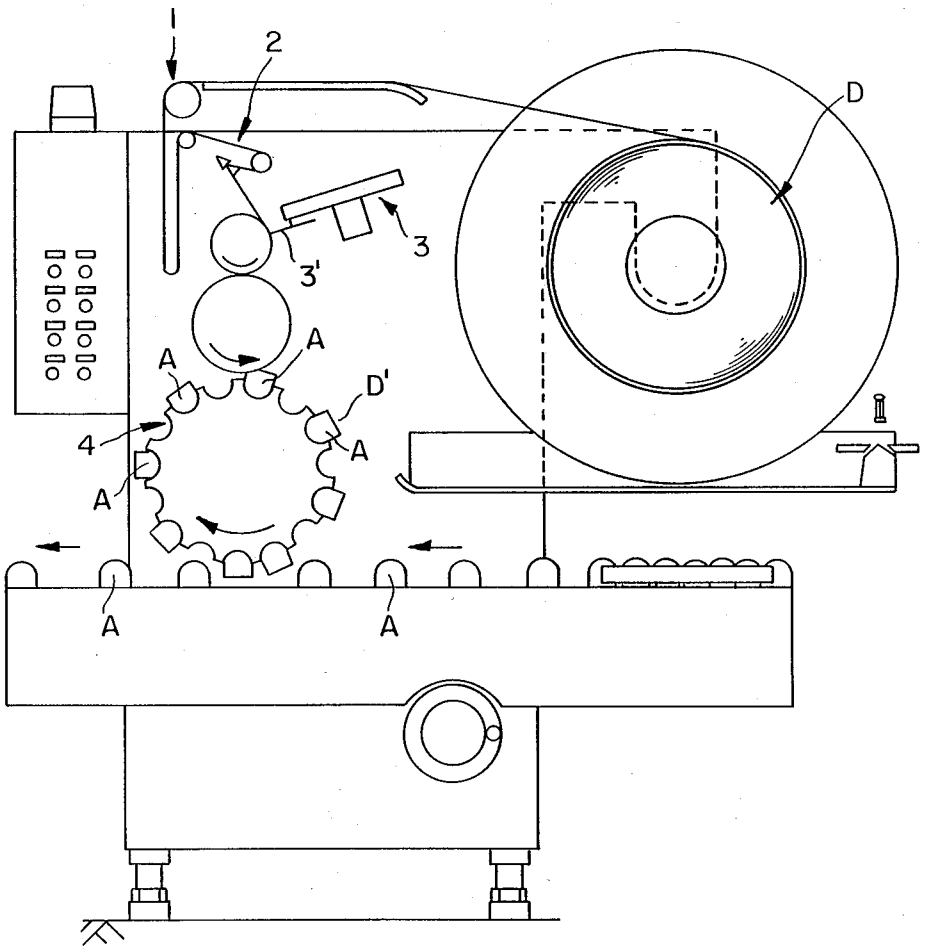
FIG. 3 is a front schematic view of a spoon adhering machine.
Figure 4:
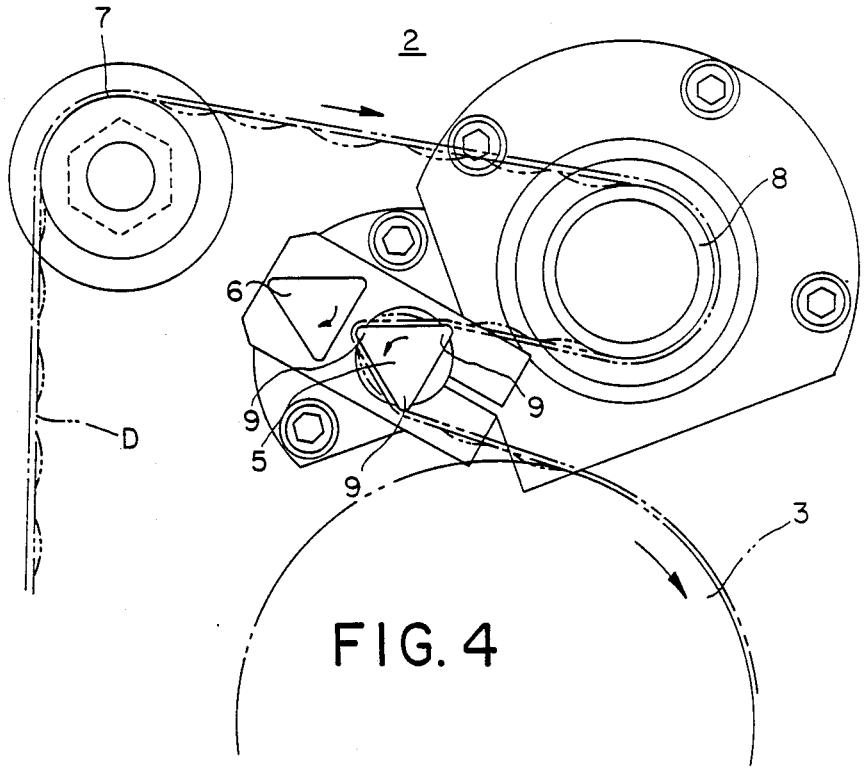
FIG. 4 is an enlarged view only of a feed device in accordance with the teachings of applicant's invention for a spoon adhering machine.

FIG. 4 is an enlarged view only of a feed device in accordance with the teachings of applicant's invention for a spoon adhering machine such as in FIG. 3. The feed device 2 includes a triangular-pillar like rotational member 5 and a rising preventing member 6 of triangular-pillar shape provided adjacent to the rotational member 5 which turns in an opposite direction in synchronism with the rotational member 5. Thus, the winding hang of the long and narrow strip of continuous package D which is hung around guide rollers 7 and 8 over the rotation member 7 is followed by the supplying of the long and narrow strip of continuous package D to the cutter mechanism 3 which will perform the subsequent process.

The cutter mechanism 3 includes a disc shape rotational blade 3' through which the long and narrow strip of continuous package D passes to be cut during the period in which the feeding of long and narrow strip of continuous package D is suspended. In interlocking motion with the rotational blade 3' of the cutter mechanism, the rotational member 5 makes intermittent rotational movement of one third of a complete turn per pitch, whereby the long and narrow strip of continuous package D is fed out by one distance equivalent to the width of a package D' containing a spoon B every intermittent rotational movement of the rotational member 5. The manner and means of producing the interlocking motion will be described later in conjunction with the description of FIG. 6.

Next the operation and feeding of the long and narrow strip of continuous package D as it is fed out by the rotational member 5 will be described in conjunction with FIG. 5.

Figure 5E:
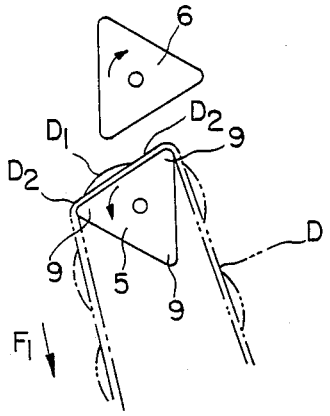
FIG. 5 is a front view illustrating the process during which the long and narrow strip of continuous package is fed out.
Figure 5F:
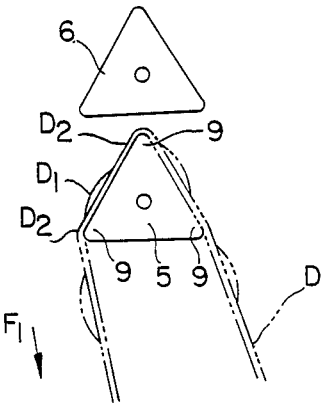
Figure 5A:
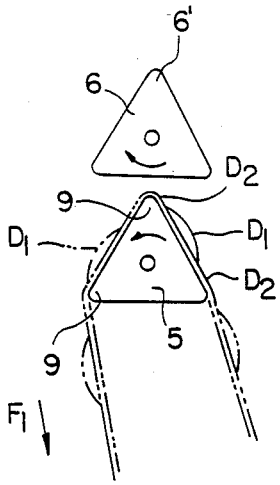
Figure 5B:
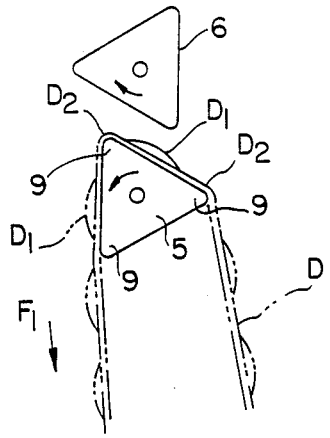

As shown in FIG. 5*a* the long and narrow strip of continuous package D which is windingly hung over the triangular-pillar like rotational member 5 supported at its packaging part $D_1$ containing the spoon B made of an unbending rigid body and its soft welded part C just after the last package part $D_1$, i.e. its connecting part $D_2$ by the ridge part 9 of the triangular-pillar (shown as a summit or ridge of the triangle in the drawings). that is, the long and narrow strip of continuous package D which is drawn by a constant tension $F_1$ by the cutter mechanism is supported at its soft connecting part $D_2$ by the ridge part of the rotational member 5 being drawn forward while sliding on the ridge part 9 thereof. When the packaging part $D_1$ containing the rigid spoon is in contact with the ridge part 9, the inability of the spoon B to be bent produces a marked resistance so that the relative relationship between a long and narrow strip of continuous package $D_1$ and rotational member 5 is corrected. If the packaging part $D_1$ extends from the predetermined position, the tension F should be changed to return it to its original position.

Figure 5C:
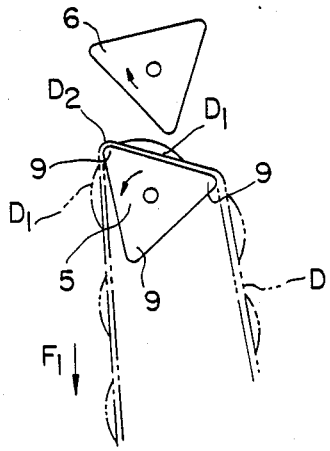
Figure 5D:
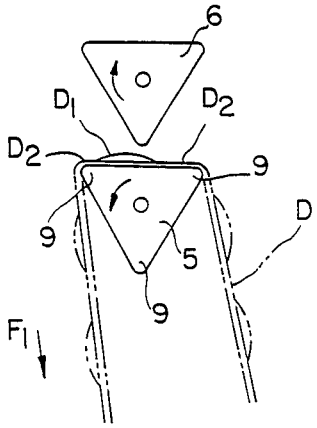

The rotational member 5 commences to make rotational movement from the state shown in FIG. 5*a* and passes through each of the states as shown in FIGS. 5*b*, 5*c*, 5*d* and 5*e* and reaches the states as shown in FIG. 5*f*; i.e. finishes by turning 120°, feeding out the long and narrow strip of continuous package D by a distance equivalent to the package D' so that the rotational member 5 stops once. With the advance of the rotational member 5 through the states as shown in FIGS. 5*c* through 5*e*, a clearance between the feeding state of the long and narrow strip of continuous package D and the rotational member 5 takes place. In other words, the angle at which the package part $D_1$ is bent by the ridge part 9 is slackened and the packaging part D' rises so that it becomes easily slidable. To prevent this from rising the rising preventive member 6 is actuated. As for the rising preventive member 6, located adjacent to the rotational member 5, a stationary unit may be applicable thereto so long as it allows the rotational member 5 to turn. A further alternative may adapt the rising preventive member 6 to rotate in synchronism with the rotational member 5 so that the distance between the packaging part $D_1$ and the rising preventive member 6 is maintained as small as possible, thereby making the effect of preventing the rise greater. For example, it is possible to put a belt or roller pushing the packaging part $D_1$ into practical use as the rising preventive member 6.

Figure 8:
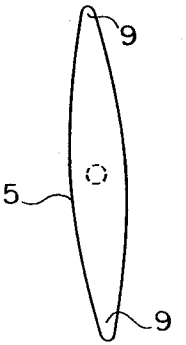
FIG. 8 is a front view of another embodiment of the rotation member of the feed device.
Figure 9:
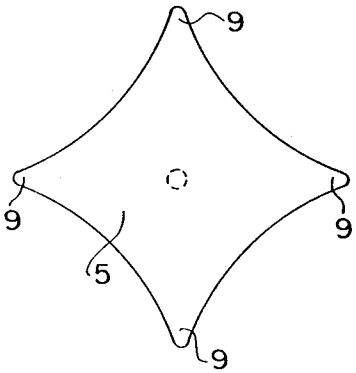
FIG. 9 is a front view of another embodiment of the rotation member of the feed device.

Variants such as a flat plate shown in FIG. 8 or a polygonal pillar having more than four sides as shown in FIG. 9 may be applicable as the rotational member 5 and may be used only if they meet the requirements that they should have a plurality of parallel ridge parts 9 provided uniformly.

When a polygonal pillar having more than four sides is employed as the rotational member 5, the package D' can be more easily slidable thereon because the ridge part of the rotational member 5 makes an obtuse internal angle. For this reason, as shown in FIG. 9, it is preferrable to have a ridge part formed as an acute angle by means of making a depression in the rotational member 5. There is, however, still no alternative but incur the slidability of the long and narrow strip of continuous package D on the rotational member's ridge part, adjacent to each other, between the parts of which the long and narrow strip of continuous package D is drawn.

In view of the above, the triangular-pillar shape is preferrably applied to the rotational member 5 and additionally the rising preventive member 6 should be of the same shape and rotated in synchronism with the rotational member 5 to thereby produce the greatness effectiveness.

Figure 7:
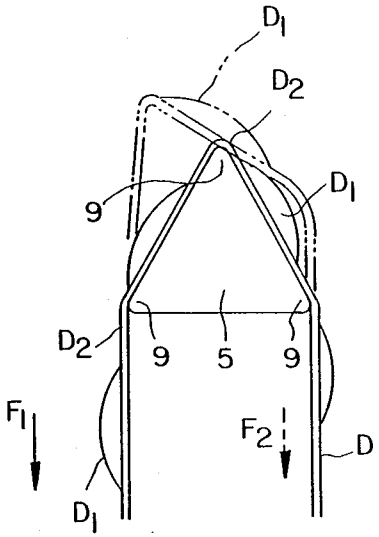
FIG. 7 is a front view of the state in which the long and narrow strip of continuous package is windingly hung over the rotational member of the feed device.

The rising preventive member 6 is not always needed and as shown in FIG. 7 it is permissible to use the rotational member 5 independently. Such a possibility is based on the fact that the effect of correcting the position of the long and narrow strip of continuous package on the ridge part 9 of the rotational member 5 is subject to a correlation between the change in rigidity of the packaging part $D_1$ of the long and narrow strip of continuous package D and the connecting part $D_2$ thereof and the tension $F_1$ and $F_2$. If the tension $F_1$ exceeds another tension $F_2$ as shown by an imaginary line in FIG. 7, the packaging part $D_1$ passes beyond the ridge part 9 of the rotational member 5 so that it rises; but when the difference between $F_1$ and $F_2$ is within a constant range, this fear can be avoided.

With regard to the tension $F_1$ and $F_2$, one of which may be increased compared with the other, if the tension $F_1$ working in the advance direction is increased, the standard for correcting the position is set to the front end of the packaging part; whereas if the tension $F_2$ working in the incoming direction is increased, the standard therefor is set to rear end of the packaging part $D_1$.

An alternative from the embodiment illustrated in the drawings, wherein the length of one side of the triangular-pillar is approximately equal to the measurement P of one piece of package D', may be made in a manner that the length of one side of the triangular-pillar of the rotational member 5 equals the measurements of more than two pieces of packages D' so that the angle at which the rotational member 5 takes the rotational motion is decreased. Furthermore, a practical use of the rotational member 5 may be applied to feeding out a plurality of packages as a unit.

Notice ought to be taken of the necessity that there should be a change in rigidity between the packaging part of the long and narrow strip of continuous package and the connecting part thereof so that the present invention may be put into practical use. Furthermore when there is warpage in the position into which the long and narrow strip of continuous package is fed out in response to the subsequent process, or when the primary position, into which the long and narrow strip of continuous package is first fed out, is necessary to be established, proper adjustment may be made by changing the starting position (phase) of only the rotational member 5 interlocked with the subsequent process.

Figure 6:
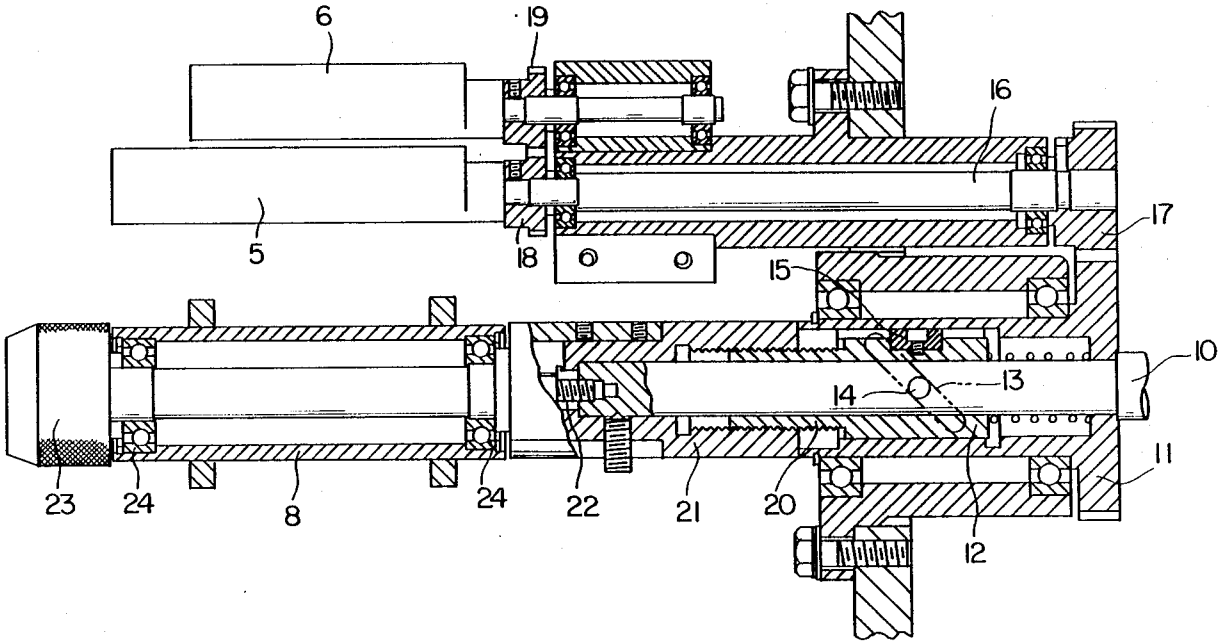
FIG. 6 is a longitudinal side view of part of the feed device.

Next, one example of adjusting the phase between the motion of the cutter blade 3' and the rotational member 5 is described in conjunction with FIG. 6. In FIG. 6 a gear 11 and a sleeve 12 are freely fit on a driving shaft 10 interlocked with the cutter mechanism 3 subsequently performing the next process. A long hole 13 is provided in the sleeve 12 in an oblique (spiral) direction, and a pin 14 projecting from the driving shaft 10 is fit in said long hole 13. Then, an interlocking between the sleeve 12 and the gear 11 is made by a key 15. Such a construction transmits a turn of the driving shaft 10 to the sleeve 12 by means of the pin 14 and from the sleeve 12 it is transmitted to the gear 11 by the key 15. Together with the key 15 on the driving shaft 10 which is in mesh with gears 17 on the shaft 16 of the rotational member 5, is another group of gears 18 and 19 which synchronize the rotational motion of the rotational member 5 with that of the rising preventive member 6. A female screw 21 threaded on the male screw 20 which is provided on the front end of the sleeve 12 is mounted on the driving shaft 10 by a small screw 22. This means that the female screw 21, which is rotatable, is not set to freely move axially. For this reason in order to change the phase of the rotational member 5, a knob 23 connected to the female screw 21 is turned whereby the sleeve 12 threaded into the knob 23 moves forward and backward. Since the sleeve 12 and the driving shaft 10 are engaged with a spiral shaped long hole by the pin 14, the relative rotational position between the driving shaft 10 and the sleeve 12 is correspondingly changed, i.e. the phase between the rotational member 5 and the driving shaft 10.

According to the feed device for the long and narrow strip of continuous package of the present invention, since there is the possibility of accurately feeding out the package to the subsequent process with the rigidity of packages or other articles provided as a standard for the working process, even if the pitch between packages of the long and narrow strip of continuous package D is forced to be changed due to an error in production or a change in temperature, no change in feeding number takes place.

In the illustrated embodiment wherein the long and narrow strip of continuous package is cut into small units of packages, may make it needless to fear that goods of inferior quality will be provided by reason of the cutting position going wide of the welded part by mistake. Furthermore, in the foregoing embodiment, wherein the rising preventive member is combined with the feeding device, adapts the rising preventive member 6 to be stably and accurately operated.

Furthermore, if an adjustment of the phase between the rotational position of the rotational member 5 and the interlocking of the rotational member 5 with the subsequent process is possible, the feed device for the long and narrow strip of continuous package D, according to the present invention, can be put into practical use for various types of packages so long as the pitch of the long and narrow strip of continuous package is different to an extent within a range wherein such a difference can be absorbed by sliding on the rotational member 5.

The above described embodiments are merely illustrative of but a few of the many specific embodiments employing the principals and objects of the present invention. Numerous and varied other arrangements can be readily devised by those skilled in the art without departing from the spirit and scope of the present invention.

I claim:

1. A feed device for feeding and controlling the position of wrapped articles before they are separated from an imperforate continuous package of articles wherein the continuous package includes a plurality of wrapped rigid articles connected together by a connecting part and wherein a material for the connecting part and the continuous package is flexible, said feeding device is characterized by a rotatable member in contact with the continuous package, a plurality of ridged parts provided in parallel to each other on the rotatable member which engage with the continuous package, a means for applying tension to said continuous package, said tension being strong enough to draw the flexible portion of the package over the ridge of the rotatable member and being weaker than a resistance created by the article contained in the packages inability to bend and a rising preventive device provided adjacent said rotatable member and driven to rotate in synchronism in an opposite direction to said rotatable member, said rising preventive device being a triangle and each corner of the triangle is an acute angle.

2. A feed device according to claim 1, wherein said rotatable member is triangular.

3. A feed device according to claim 2, wherein each corner of the triangular rotatable member is an acute angle.

4. A feed device according to claim 1, wherein said rotatable member is plate-like.

5. A feed device according to claim 1, wherein said rotatable member is a polygon of four sides.

6. A feed device according to claim 1 wherein said rising preventing device is not in continuous contact with the imperforate continuous package of articles.

* * * * *